US011124728B2

(12) United States Patent
Oh

(10) Patent No.: US 11,124,728 B2
(45) Date of Patent: Sep. 21, 2021

(54) CONTINUOUSLY VARIABLE TRANSMISSION OIL COMPOSITION HAVING IMPROVED FUEL EFFICIENCY AND DURABILITY

(71) Applicants: HYUNDAI MOTOR COMPANY, Seoul (KR); KIA MOTORS CORPORATION, Seoul (KR)

(72) Inventor: Jung Joon Oh, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/918,387

(22) Filed: Jul. 1, 2020

(65) Prior Publication Data

US 2021/0155869 A1 May 27, 2021

(30) Foreign Application Priority Data

Nov. 26, 2019 (KR) ..... 10-2019-0153068

(51) Int. Cl.

| | |
|---|---|
| ***C10M 107/02*** | (2006.01) |
| ***C10M 149/12*** | (2006.01) |
| ***C10M 153/02*** | (2006.01) |
| ***C10M 145/14*** | (2006.01) |
| *C10N 40/04* | (2006.01) |
| *C10N 20/00* | (2006.01) |
| *C10N 30/04* | (2006.01) |

(52) U.S. Cl.

CPC ..... *C10M 107/02* (2013.01); *C10M 145/14* (2013.01); *C10M 149/12* (2013.01); *C10M 153/02* (2013.01); *C10N 2020/071* (2020.05); *C10N 2030/04* (2013.01); *C10N 2040/045* (2020.05)

(58) Field of Classification Search

CPC ..... C10M 107/02; C10M 149/12; C10M 153/02; C10M 145/14; C10N 2040/045; C10N 2020/071; C10N 2030/04

See application file for complete search history.

(56) References Cited

U.S. PATENT DOCUMENTS

| | | | | |
|---|---|---|---|---|
| 8,921,290 | B2 * | 12/2014 | Lee | C10M 171/04 508/583 |
| 10,059,898 | B2 * | 8/2018 | Han | C10M 105/04 |
| 2007/0000807 | A1 * | 1/2007 | Wu | C10M 169/04 208/18 |
| 2013/0184191 | A1 * | 7/2013 | Lee | C10M 107/02 508/591 |
| 2014/0113847 | A1 * | 4/2014 | Givens | C10M 169/041 508/468 |
| 2017/0137732 | A1 * | 5/2017 | Utaka | C10L 1/1641 |
| 2018/0134983 | A1 * | 5/2018 | Broutin | C08L 71/02 |

FOREIGN PATENT DOCUMENTS

KR 2013-0017457 A 2/2013

* cited by examiner

*Primary Examiner* — Cephia D Toomer

(74) *Attorney, Agent, or Firm* — McDonnell Boehnen Hulbert & Berghoff LLP

(57) ABSTRACT

The present disclosure relates to a continuously variable transmission oil composition containing a base oil containing a metallocene polyalpha olefin (mPAO) polymerized with a metallocene catalyst, a viscosity controlling agent containing Polybutadiene hydrogen phosphate Comb Polymethacrylate, and a clean dispersant, and contains mPAO and PHP Comb PMA, which have not been used previously, at a specific ratio to maximize the reduction in low-temperature viscosity while effectively forming an oil film, thereby enhancing fuel efficiency, and at the same time, enhancing durability of a transmission by increasing viscosity.

2 Claims, No Drawings

CONTINUOUSLY VARIABLE TRANSMISSION OIL COMPOSITION HAVING IMPROVED FUEL EFFICIENCY AND DURABILITY

CROSS REFERENCE TO RELATED APPLICATIONS

This application claims under 35 U.S.C. § 119(a) the benefit of priority to Korean Patent Application No. 10-2019-0153068 filed on Nov. 26, 2019, the entire contents of which are incorporated herein by reference.

BACKGROUND

(a) Technical Field

The present disclosure relates to a continuously variable transmission oil composition containing a base oil containing metallocene polyalpha olefin (mPAO) polymerized with a metallocene catalyst, a viscosity controlling agent containing Polybutadiene hydrogen phosphate Comb Polymethacrylate, and a clean dispersant.

(b) Background Art

In recent years, regulations on vehicle exhaust gas such as carbon dioxide have been stricter to efficiently use energy and prevent global warming, and in order to cope with such environmental regulations, fuel-efficiency enhanced engine oil and transmission oil that may reduce energy loss of an engine has been actively developed. In particular, if the viscosity of the engine or transmission oil is reduced, the energy lost by the fluid resistance when power is delivered may be minimized. On the other hand, if the viscosity is reduced, it is disadvantageous in durability because the thickness of an oil film also becomes thin to increase the friction between metals.

Therefore, it is necessary to develop a continuously variable transmission oil that may enhance fuel efficiency by reducing fluid resistance while maximizing the reduction in low-temperature viscosity, and at the same time, enhance durability of a transmission by increasing viscosity.

The above information disclosed in this Background section is only for enhancement of understanding of the background of the disclosure and accordingly it may contain information that does not form the prior art that is already known in this country to a person of ordinary skill in the art.

SUMMARY

The present disclosure is intended to solve the above problem, and the specific object thereof is as follows.

An object of the present disclosure is to provide a continuously variable transmission oil composition containing a base oil containing mPAO and a viscosity controlling agent containing Polybutadiene hydrogen phosphate Comb Polymethacrylate in a specific content, which are effective for maximizing the oil film formation and the reduction in low-temperature viscosity.

The object according to the present disclosure is not limited to the above-mentioned object. The object according to the present disclosure will become more apparent from the following description, and will be realized by the means described in the claims and a combination thereof.

A continuously variable transmission oil composition according to an embodiment of the present disclosure contains a base oil, a viscosity controlling agent, and a clean dispersant.

The continuously variable transmission oil composition may contain 73 to 85 wt % of the base oil, 8 to 20 wt % of the viscosity controlling agent, and 6 to 10 wt % of the clean dispersant.

The base oil may contain one selected from the group consisting of metallocene polyalpha olefin (mPAO) polymerized with a metallocene catalyst, polyalpha olefin (PAO), paraffinic hydrocarbon compound, and combinations thereof.

The metallocene polyalpha olefin (mPAO) polymerized with the metallocene catalyst may contain 1 to 5 wt % based on 100 wt % of the base oil.

The viscosity controlling agent may contain Comb Polymethacrylate (Comb PMA) that connects any one or more of polar and non-polar branches to a main chain.

The viscosity controlling agent may contain Polybutadiene hydrogen phosphate Comb Polymethacrylate (PHP Comb PMA).

The clean dispersant may contain Polyisobutenyl succinimide.

The continuously variable transmission oil composition may further contain an additive selected from one group consisting of anti-wear agent, friction controlling agent, extreme pressure agent, antioxidant, and combinations thereof.

The additive may contain 1 wt % to 5 wt % based on 100 wt % of the continuously variable transmission oil composition, and the additive may be zinc alkyl dithiophosphate as the anti-wear agent.

A continuously variable transmission oil according to an embodiment of the present disclosure contains a continuously variable transmission oil composition, and an average kinematic viscosity (40° C.) may be 19 to 24 cSt, an average low-temperature viscosity (−40° C.) may be 5000 to 6900 cP, a fuel efficiency enhancement rate may be 0.3 to 2.2%, and a FZG gear endurance time may be 96 to 135 hours.

The continuously variable transmission oil composition and the continuously variable transmission oil containing the same according to the present disclosure may contain the metallocene polyalpha olefin (mPAO) polymerized with the metallocene catalyst and Polybutadiene hydrogen phosphate Comb Polymethacrylate (PHP Comb PMA), which have not been used previously, at a specific ratio to maximize the reduction in the low-temperature viscosity while effectively forming the oil film, thereby enhancing the fuel efficiency, and at the same time, enhancing durability of the transmission by increasing the viscosity.

The effects according to the present disclosure are not limited to the effects mentioned above. It should be understood that the effects according to the present disclosure include all the effects inferable from the following description.

It is understood that the term "vehicle" or "vehicular" or other similar term as used herein is inclusive of motor vehicles in general such as passenger automobiles including sports utility vehicles (operation SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

DETAILED DESCRIPTION

As described above, objects, other objects, features, and advantages according to the present disclosure will be readily understood through the following preferred embodiments associated with the accompanying drawings. However, the present disclosure is not limited to the embodiments described herein and may also be embodied in other forms. Rather, the embodiments introduced herein are provided so that the disclosure may be made thorough and complete, and the spirit according to the present disclosure may be sufficiently conveyed to those skilled in the art.

In this specification, it should be understood that terms such as "comprise" or "have" are intended to indicate that there is a feature, a number, a step, an operation, a component, a part, or a combination thereof described on the specification, and do not exclude the possibility of the presence or the addition of one or more other features, numbers, steps, operations, components, parts, or combinations thereof.

Unless otherwise indicated, all numbers, values, and/or expressions referring to quantities of ingredients, reaction conditions, polymer compositions, and formulations used herein are to be understood as modified in all instances by the term "about" as such numbers are inherently approximations that are reflective of, among other things, the various uncertainties of measurement encountered in obtaining such values. Further, where a numerical range is disclosed herein, such range is continuous, and includes unless otherwise indicated, every value from the minimum value to and including the maximum value of such range. Still further, where such a range refers to integers, unless otherwise indicated, every integer from the minimum value to and including the maximum value is included.

Continuously Variable Transmission Oil Composition

A continuously variable transmission oil composition according to an embodiment of the present disclosure may contain a base oil, a viscosity controlling agent, and a clean dispersant, and preferably, may further contain an additive that is one selected from the group consisting of anti-wear agent, friction controlling agent, extreme pressure agent, antioxidant, and combinations thereof.

The continuously variable transmission oil composition according to the present disclosure may contain 73 to 85 wt % of the base oil, 8 to 20 wt % of the viscosity controlling agent, and 6 to 10 wt % of the clean dispersant, and preferably, may further contain 1 wt % to 5 wt % of the additive.

It is revealed in advance that the content of each component of the continuously variable transmission oil composition according to the present disclosure to be described below is based on 100 wt % of the continuously variable transmission oil composition. If the reference is changed, the changed reference will always be specified, such that those skilled in the art will clearly know that the content is described based on which configuration.

(1) Base Oil

A base oil according to the present disclosure is not particularly limited as long as it contains a basic constituent of the lubricating oil and a material that is advantageous for the oil film formation.

The base oil according to the present disclosure may contain one selected from the group consisting of metallocene polyalpha olefin (mPAO) polymerized with a metallocene catalyst, polyalpha olefin (PAO), paraffinic hydrocarbon compound, and combinations thereof, and although not limited to a specific component, preferably, it is preferable to contain mPAO that is advantageous for the oil film formation.

The polyalpha olefin among the metallocene polyalpha olefins (mPAO) polymerized with the metallocene catalyst according to the present disclosure is called a Group 4 oil and as a material that is produced through the polymerization reaction on olefin, has a high elasticity characteristic due to the double bond of carbon and carbon. In addition to Poly Alpha Olefin (PAO), which is one of synthetic base oils, there is ester, or the like, but the present disclosure is characterized by using the Poly Alpha Olefin (PAO). The Poly Alpha Olefin (PAO) is extracted between LPG and gasoline when crude oil is refined, and has the advantages of little impurities and long life, while the ester is extracted from plants without being extracted from crude oil and has the disadvantages of very high price and short service life due to the small quantity production. Therefore, the present disclosure uses the Poly Alpha Olefin (PAO) that may have low consumption of the engine oil and exert the economic effect. Furthermore, if the present disclosure uses one having polymerized a metallocene catalyst to the Poly Alpha Olefin, there are the advantages that may reduce the viscosity of the overall composition even more effectively than the PAO, and have the excellent fuel efficiency enhancement effect by reducing the coefficient of friction due to the good lubrication film formation.

Further, the base oil according to the present disclosure may further contain a base oil corresponding to paraffinic hydrocarbon compound in addition to the mPAO, for example, a Group 3 among the classifications according to the criteria of the Mineral base oil specified by the American Petroleum Institute (API). The base oil of the Group 3 is characterized in that the content of Sulfur is more than 0 and less than 0.03 wt %, Saturates are 90 wt % or more, and a Viscosity index is 120 or more. Further, there is the advantage of being able to be used without deformation for a long time due to the good adaptability of the low temperature and high temperature, the anti-oxidation function and the excellent viscosity retention.

The base oil according to the present disclosure may contain 73 to 85 wt % based on a total 100 wt % of the continuously variable transmission oil composition. There is the disadvantage of reducing fuel efficiency by increasing the viscosity as the contents of other additives are increased if the content of the base oil is less than 73 wt %, and there is the disadvantage of deteriorating durability, anti-wear property, and the like due to low contents of other additives if it exceeds 85 wt %.

Further, the mPAO contained in the base oil may contain 1 to 5 wt % based on a total 100 wt % of the base oil. There is the disadvantage of reducing durability enhancement effect if the content of the mPAO is less than 1 wt %, and there is the disadvantage of reducing the fuel efficiency enhancement effect due to an increase in fluid friction and viscosity if it exceeds 5 wt %.

(2) Viscosity Controlling Agent

A viscosity controlling agent according to the present disclosure functions to reduce the viscosity difference of the continuously variable transmission oil at high and low temperatures, that is, it is not particularly limited as long as it serves to reduce the viscosity of the continuously variable transmission oil that increases if the continuously variable transmission oil is a low temperature, thereby enhancing the startability and fuel efficiency of the vehicle, and to increase the viscosity of the continuously variable transmission oil that reduces if the continuously variable transmission oil is a high temperature, thereby forming a constant oil film on a metal surface so that inter-metallic friction and abrasion do not occur.

The viscosity controlling agent according to the present disclosure may contain a typical viscosity controlling agent, which may reduce the viscosity difference at high and low temperatures in the continuously variable transmission oil, for example, Comb Polymethacrylate (Comb PMA), Asteric, Olefin Copolymer (OCP), Styrene Butadiene Rubber (SBR), LSH Polymethacrylate (LSH PMA), and the like, preferably, may contain Comb Polymethacrylate (Comb PMA) that connects any one or more of polar and non-polar branches to a main chain, and more preferably, may contain Polybutadiene hydrogen phosphate Comb Polymethacrylate (PHP Comb PMA) that has excellent high-temperature expandability and low-temperature shrinkage.

The PHP Comb PMA may have a structural formula as illustrated in Formula 1 below.

Formula 1

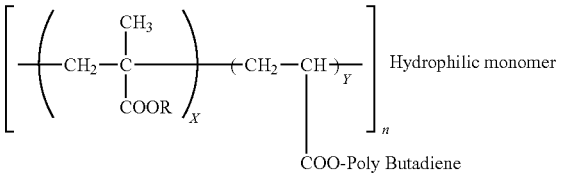

At this time, the Hydrophilic monomer may contain a monomer having a Hydrogen phosphate structure as in Formula 2 below; and the ratio of the blocks X and Y is 1:2 to 1:3, the weight average molecular weight (Mw) may be 150,000 to 300,000, and the weight average molecular weight (Mw) of the Poly butadiene may be 1 to 20 carbon atoms that are 1,500 to 2,500.

Formula 2

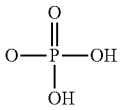

That is, the present disclosure may introduce a side chain in which a Hydrophilic monomer is introduced into the main chain of Comb Polymethacrylate (Comb PMA) and introduce Polybutadiene into a carboxylate group bonded to the main chain, for example, may change polarity to maximize low-temperature shrinkage and high-temperature expandability on temperature, thereby enhancing fuel efficiency by reducing the low-temperature viscosity of the continuously variable transmission oil, and also enhancing durability by increasing the high-temperature viscosity.

The viscosity controlling agent according to the present disclosure may contain 8 to 20 wt % based on a total 100 wt % of the continuously variable transmission oil composition. There is the disadvantage in that the fuel efficiency enhancement effect is insignificant due to an insufficient decrease in viscosity if the content of the viscosity controlling agent is less than 8 wt %, and there is the disadvantage in that low-temperature operability is deteriorated due to an increase in the low-temperature viscosity if it exceeds 20 wt %.

(3) Clean Dispersant

A clean dispersant according to the present disclosure is not particularly limited as long as it may suppress deposition and abrasion of oxides, some sludges, or the like in a transmission system.

The clean dispersant according to the present disclosure may contain a typical clean dispersant that may be used in the continuously variable transmission oil, for example, Polyisobutenyl succinimide, calcium or magnesium-based dispersant, sulfonate of alkaline earth metal (calcium, magnesium, barium, and the like), phenate, salicylate, or the like and is not limited to specific clean dispersants, but may be Polyisobutenyl succinimide represented by Formula 3 below that may affect shift characteristics by maintaining an optimum coefficient of friction.

Formula 3

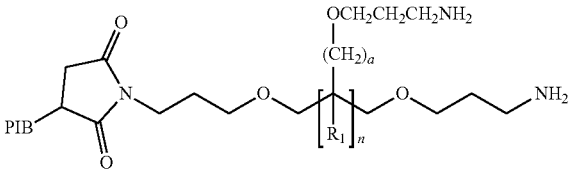

The clean dispersant according to the present disclosure may contain 6 to 10 wt % based on a total 100 wt % of the continuously variable transmission oil composition. There is the disadvantage of weakening cleanliness and durability if the content of the clean dispersant is less than 6 wt %, and there is the disadvantage of reducing fuel efficiency due to friction performance and high viscosity if it exceeds 10 wt %.

(4) Additive

An additive according to the present disclosure is not particularly limited as long as it does not weaken the physical properties of the continuously variable transmission oil composition containing the same.

The additive may be a typically known additive that may be used in the continuously variable transmission oil composition according to the present disclosure, for example, may be selected from the group consisting of anti-wear agent, friction controlling agent, extreme pressure agent, antioxidant, antifoaming agent, and combinations thereof and is not limited to specific additives.

The anti-wear agent may prevent abrasion by forming a protective film on a friction metal surface, and may contain a typically known anti-wear agent, for example, Zinc Alkyl Dithiophosphate (ZnDTP), molybdenum dithiocarbamate (MoDTC), dibutyl hydrogen phosphite, linseed phosphite, isobutyenyl succinic ester, and the like. Further, the antioxidant may prevent oxidation of the continuously variable transmission oil composition, and may contain, for example, amine-based antioxidants such as 3-hydroxydiphenylamine and phenyl-alpha-naphthylamine. Further, the antifoaming agent may contain silicone-based antifoaming agent, Polymethacrylate, or the like.

The additive, preferably, the continuously variable transmission oil composition containing the same may contain anti-wear agent that forms the protective film on the friction metal surface to prevent abrasion, and more preferably, may be zinc alkyl dithiophosphate (ZnDTP). The ZnDTP may be classified into a primary-ZnDTP or a secondary-ZnDTP according to the number of substituted alkyl groups: the primary-ZnDTP may have one alkyl group having 8 to 30 carbon atoms substituted at the terminal, and the secondary-ZnDTP may have two alkyl groups having 8 to 30 carbon atoms substituted. In the present disclosure, the ZnDTP may use the primary-ZnDTP, the secondary-ZnDTP, or a mixture thereof.

The additive according to the present disclosure may further contain 1 to 5 wt % based on a total 100 wt % of the continuously variable transmission oil composition. There is the disadvantage of weakening the anti-wear property if the content of the additive is less than 1 wt %, and there is the disadvantage of weakening the friction performance if it exceeds 5 wt %.

Continuously Variable Transmission Oil

The continuously variable transmission oil according to the present disclosure contains the continuously variable transmission oil composition, and may be 19 to 24 cSt of the average kinematic viscosity (40° C.), 5000 to 6900 cP of the average low-temperature viscosity (−40° C.), 0.3 to 2.2% of a fuel efficiency enhancement rate, and 96 to 135 hours of a FZG gear endurance time.

Therefore, the continuously variable transmission oil composition according to the present disclosure and the continuously variable transmission oil containing the same may contain metallocene polyalpha olefin (mPAO) polymerized with a metallocene catalyst and Polybutadiene hydrogen phosphate Comb Polymethacrylate (PHP Comb PMA) at a specific ratio to maximize the reduction in low-temperature viscosity while effectively forming the oil film, thereby enhancing fuel efficiency, and at the same time, enhancing durability of the transmission by increasing viscosity.

Hereinafter, the present disclosure will be described in more detail through the specific embodiments. The following embodiments are merely examples for helping understanding of the present disclosure, but the scope of the present disclosure is not limited thereto.

Embodiments 1 to 13 and Comparative Examples 1 to 15: Production of the Continuously Variable Transmission Oil Composition The continuously variable transmission oil composition was produced by injecting the components illustrated in Table 1 below into a reactor, and mixing them under a condition of 40 to 60° C. of temperature and 500 to 1000 rpm of a blender speed.

[Each Component Constituting the Continuously Variable Transmission Oil Composition]

(1) Base Oil

Metallocene polyalpha olefin (mPAO) polymerized with a metallocene catalyst: at 100° C., the kinematic viscosity was 150 to 160 cSt and the weight average molecular weight (Mw) was 1,000 to 30,000 g/mol (product by Exxon Mobil Co.).

(2) Viscosity Controlling Agent

Polybutadiene hydrogen phosphate Comb Polymethacrylate with hydrogen phosphate and Polybutadiene introduced: the ratio of X and Y was 1:2 to 1:3, and the hydrogen phosphate monomer contains 10 to 30 wt % of the viscosity controlling agent, the Polybutadiene has 1 to 20 carbon atoms that are 1,500 to 2,500 of the weight average molecular weight. The overall viscosity controlling agent has 150,000 to 300,000 of the weight average molecular weight.

Comb Polymethacrylate (Comb PMA): product by Rohmax Inc.

Asteric Polymethacrylate (Asteric PMA): product by Lubrizol Co.

(3) Clean dispersant: Polyisobutenyl succinimide (product by Lubrizol Co.)

(4) Anti-wear agent: Zinc Alkyl Dithiophosphate (ZnDTP, product by Lubrizol Co.)

TABLE 1

| Composition (wt %) | | Embodiments 1 | 2 | 3 | 4 | 5 | 6 | 7 | 8 | 9 |
|---|---|---|---|---|---|---|---|---|---|---|
| Base Oil | Yubase3 | 77 | 76 | 75 | 74 | 73 | 78 | 74 | 76 | 72 |
| | mPAO | 2 | 2 | 2 | 2 | 2 | 1 | 1 | 3 | 3 |
| Viscosity controlling agent | PHP Comb PMA | 10 | 11 | 12 | 13 | 14 | 10 | 14 | 10 | 14 |
| | Comb PMA | — | — | — | — | — | — | — | — | — |
| | PMA | — | — | — | — | — | — | — | — | — |
| Clean dispersant | Polyisobutenyl succinimide | 8 | 8 | 8 | 8 | 8 | 8 | 8 | 8 | 8 |
| Anti-wear agent | Zinc Alkyl Dithiophosphate | 3 | 3 | 3 | 3 | 3 | 3 | 3 | 3 | 3 |
| Total content | | 100 | 100 | 100 | 100 | 100 | 100 | 100 | 100 | 100 |

TABLE 2

| Composition (wt %) | | Comparative Examples 1 (present specification) | 2 | 3 | 4 | 5 | 6 | 7 | 8 | 9 |
|---|---|---|---|---|---|---|---|---|---|---|
| Base Oil | Yubase3 | 81 | 78 | 72 | 77 | 77 | 78 | 79 | 73 | 77 |
| | mPAO | — | 2 | 2 | — | 2 | 2 | 1 | 1 | 3 |
| Viscosity controlling agent | PHP Comb PMA | — | 9 | 15 | 12 | — | — | 9 | 15 | 9 |
| | Comb PMA | — | — | — | — | 10 | — | — | — | — |
| | PMA | 8 | — | — | — | — | 9 | — | — | — |

TABLE 2-continued

| Composition (wt %) | | Comparative Examples | | | | | | | | |
|---|---|---|---|---|---|---|---|---|---|---|
| | | 1 (present specification) | 2 | 3 | 4 | 5 | 6 | 7 | 8 | 9 |
| Clean dispersant | Polyisobutenyl succinimide | 8 | 8 | 8 | 8 | 8 | 8 | 8 | 8 | 8 |
| Anti-wear agent | Zinc Alkyl Dithiophosphate | 3 | 3 | 3 | 3 | 3 | 3 | 3 | 3 | 3 |
| Total content | | 100 | 100 | 100 | 100 | 100 | 100 | 100 | 100 | 100 |

TABLE 3

| Composition (wt %) | | Embodiments | | | |
|---|---|---|---|---|---|
| | | 10 | 11 | 12 | 13 |
| Base Oil | Yubase3 | 76 | 75 | 74 | 73.5 |
| | mPAO | 1 | 2 | 3 | 3.5 |
| Viscosity controlling agent | PHP Comb PMA | 12 | 12 | 12 | 12 |
| | Comb PMA | — | — | — | — |
| | PMA | — | — | — | — |
| Clean dispersant | Polyisobutenyl succinimide | 8 | 8 | 8 | 8 |
| Anti-wear agent | Zinc Alkyl Dithiophosphate | 3 | 3 | 3 | 3 |
| Total content | | 100 | 100 | 100 | 100 |

TABLE 4

| Composition (wt %) | | Comparative Examples | | | | | |
|---|---|---|---|---|---|---|---|
| | | 10 | 11 (present specification) | 12 | 13 | 14 | 15 |
| Base Oil | Yubase3 | 71 | 81 | 76.5 | 73 | 79 | 80 |
| | mPAO | 3 | — | 0.5 | 4 | — | — |
| Viscosity controlling agent | PHP Comb PMA | 15 | — | 12 | 12 | — | — |
| | Comb PMA | — | — | — | — | 10 | — |
| | PMA | — | 8 | — | — | — | 9 |
| Clean dispersant | Polyisobutenyl succinimide | 8 | 8 | 8 | 8 | 8 | 8 |
| Anti-wear agent | Zinc Alkyl Dithiophosphate | 3 | 3 | 3 | 3 | 3 | 3 |
| Total content | | 100 | 100 | 100 | 100 | 100 | 100 |

Experimental Example

The continuously variable transmission oil compositions produced in the Embodiments 1 to 13 and the Comparative Examples 1 to 15 were evaluated by the following methods, and the results were illustrated in Tables 5 to 8 below.

[Evaluation Method]

(1) 40° C. kinematic viscosity (ASTM D445): measure the time that falls after sucking up a sample into a glass tube in a bath maintained at 40° C. to convert it into the kinematic viscosity.

(2) −40° C. low-temperature viscosity (ASTM D2983): convert it after measuring torque with a rotor after soaking a sample in a −40° C. low-temperature chamber for 12 hours.

(3) Fuel efficiency enhancement rate (FTP75 (authentication mode)): evaluate with a chassis dynamo under FTP75 North American authentication mode operation condition.

(4) FZG gear endurance time (FVA No. 2/IV): measure the fitting occurrence time after the test evaluation at 1450 rpm×90° C.×9 load stage.

TABLE 5

| Evaluation items | Unit | Embodiments | | | | | | | | |
|---|---|---|---|---|---|---|---|---|---|---|
| 40° C. kinematic viscosity | cSt | 1 | 2 | 3 | 4 | 5 | 6 | 7 | 8 | 9 |
| −40° C. low-temperature viscosity | cP | 22.0 | 21.6 | 21.0 | 20.3 | 19.5 | 21.4 | 20.1 | 21.9 | 21.5 |
| −40° C. low-temperature viscosity | cP | 5700 | 5500 | 5200 | 5300 | 5800 | 5200 | 5100 | 5600 | 5400 |

TABLE 5-continued

| Evaluation items 40° C. kinematic viscosity | Unit cSt | Embodiments 1 | 2 | 3 | 4 | 5 | 6 | 7 | 8 | 9 |
|---|---|---|---|---|---|---|---|---|---|---|
| Fuel efficiency enhancement rate | % | 0.8 | 1.5 | 2.1 | 1.7 | 1.0 | 1.6 | 1.7 | 1.2 | 1.6 |
| FZG gear endurance time | Time | 120 | 132 | 132 | 120 | 120 | 108 | 120 | 120 | 132 |

TABLE 6

| Evaluation items 40° C. kinematic viscosity | Unit cSt | Comparative Examples 1 (present specification) | 2 | 3 | 4 | 5 | 6 | 7 | 8 | 9 |
|---|---|---|---|---|---|---|---|---|---|---|
| −40° C. low-temperature viscosity | cP | 25.5 | 23.4 | 19.0 | 21.7 | 23.6 | 23.8 | 23.2 | 19.3 | 23.8 |
| −40° C. low-temperature viscosity | cP | 8300 | 6500 | 6700 | 5500 | 7800 | 7600 | 6400 | 6600 | 6500 |
| Fuel efficiency enhancement rate | % | Reference | 0.1 | 0.5 | 0.7 | 0.1 | 0.1 | 0.1 | 0.3 | 0 |
| FZG gear endurance time | Time | 96 | 96 | 84 | 72 | 108 | 108 | 96 | 84 | 78 |

TABLE 7

| Evaluation items 40° C. kinematic viscosity | Unit cSt | Embodiments 10 | 11 | 12 | 13 |
|---|---|---|---|---|---|
| −40° C. low-temperature viscosity | cP | 21.2 | 21.0 | 21.8 | 23.0 |
| −40° C. low-temperature viscosity | cP | 5100 | 5200 | 5500 | 6800 |
| Fuel efficiency enhancement rate | % | 1.7 | 2.1 | 1.5 | 0.3 |
| FZG gear endurance time | Time | 108 | 132 | 132 | 96 |

Referring to the Table 1 and Table 5 and Tables 2 and 3 and Tables 6 and 7, when 8 to 20 wt %, preferably, 10 to 14 wt % of the content of Polybutadiene hydrogen phosphate Comb Polymethacrylate (PHP Comb PMA) contained in the viscosity controlling agent according to the present disclosure was added (Embodiments 1 to 9), and when 1 to 5 wt %, preferably, 1 to 3.5 wt % based on 100 wt % of the base oil of the content of the mPAO contained in the base oil was added (Embodiments 10 to 13), it could be confirmed that the fuel efficiency increases maximally and the FZG gear endurance time increases maximally, thereby enhancing durability. In particular, it could be confirmed that the viscosities at 40° C. and −40° C. are low in the ratio of the PHP Comb PMA and the mPAO being 6:1 (12 wt %: 2 wt %), thereby maximizing the fuel efficiency enhancement and maximizing durability reinforcement (Embodiments 3, 11).

Meanwhile, it could be confirmed that there are the disadvantages in that when the content of the PHP Comb

TABLE 8

| Evaluation items 40° C. kinematic viscosity | Unit cSt | Comparative Examples 10 | 11 (present specification) | 12 | 13 | 14 | 15 |
|---|---|---|---|---|---|---|---|
| −40° C. low-temperature viscosity | cP | 22.0 | 25.5 | 21.3 | 24.0 | 23.6 | 23.8 |
| −40° C. low-temperature viscosity | cP | 6650 | 8300 | 5300 | 8300 | 7700 | 7500 |
| Fuel efficiency enhancement rate | % | 0.1 | Reference | 0.7 | 0 | 0.1 | 0.1 |
| FZG gear endurance time | Time | 84 | 96 | 84 | 96 | 72 | 72 |

PMA was less than 8 to 20 wt %, preferably, 10 to 14 wt %, a decrease in the viscosity was less and the fuel efficiency effect was less (Comparative Examples 2, 7, 9), and when it was more than 8 to 20 wt %, the viscosity was low but the viscosity at −40° C. was high, thereby causing the poor low-temperature operability and deteriorating the durability compared to the present specification (Comparative Examples 3, 8, 10). Further, it could be confirmed that when using a general Comb PMA or a general PMA without using the PHP Comb PMA, the fuel efficiency enhancement effect was insignificant due to the less viscosity reduction effect (Comparative Examples 5, 6).

Further, referring to the Tables 3 and 7 and Tables 4 and 8, it could be confirmed that when the content of the mPAO was less than the range of 1 to 5 wt %, preferably, 1 to 3.5 wt %, based on 100 wt % of the base oil, the durability was deteriorated (Comparative Example 12), and when it was more than the range of 1 to 5 wt %, the viscosity reduction effect was less and the viscosity at −40° C. was high, thereby having no fuel efficiency enhancement effect (Comparative Example 13). Further, it could be confirmed that when the mPAO was not used, the durability deterioration was not compensated due to the reduction in viscosity, thereby causing the poor durability compared to the present specification (Comparative Examples 4, 14, 15).

That is, it could be confirmed that the continuously variable transmission oil composition and the continuously variable transmission oil containing the same produced by using 1 to 5 wt % of the content of the mPAO based on 100 wt % of the base oil and 8 to 20 wt % of the content of the PHP Comb PMA could maximize the reduction in the low-temperature viscosity while effectively forming the oil film, thereby enhancing the fuel efficiency, and at the same time, enhancing the durability of the transmission by increasing viscosity.

While a number of exemplary aspects and embodiments have been discussed above, those of skill in the art will recognize that still further modifications, permutations, additions and sub-combinations thereof of the features of the disclosed embodiments are still possible. It is therefore intended that the following appended claims and claims hereafter introduced are interpreted to include all such modifications, permutations, additions and sub-combinations as are within their true spirit and scope.

The invention claimed is:

1. A continuously variable transmission oil composition, comprising:

73 to 85 wt % of a base oil;

8 to 20 wt % of a viscosity controlling agent;

6 to 10 wt % of a dispersant; and 1 to 5 wt % of zinc dithiophosphate as an anti-wear agent;

wherein the base oil comprises one selected from the group consisting of metallocene polyalpha olefin (mPAO) polymerized with a metallocene catalyst, polyalpha olefin (PAO), paraffinic hydrocarbon compound, and combinations thereof;

wherein the metallocene polyalpha olefin (mPAO) polymerized with the metallocene catalyst comprises 1 to 5 wt % based on 100 wt % of the base oil;

wherein the viscosity controlling agent comprises Comb Polymethacrylate (Comb PMA) that connects any one or more of polar and non-polar branches to a main chain of the Comb Polymethacrylate (Comb PMA);

wherein the viscosity controlling agent comprises Polybutadiene hydrogen phosphate Comb Polymethyacrylate (PHP Comb PMA); and wherein the dispersant comprises Polyisobutenyl succinimide.

2. A continuously variable transmission oil, comprising the composition of claim 1, wherein an average kinematic viscosity (40° C.) is 19 to 24 cSt, an average low-temperature viscosity (−40° C.) is 5000 to 6900 cP, a fuel efficiency enhancement rate is 0.3 to 2.2%, and a FZG gear endurance time is 96 to 135 hours.

* * * * *